US008569961B2

(12) United States Patent
Lee et al.

(10) Patent No.: US 8,569,961 B2
(45) Date of Patent: Oct. 29, 2013

(54) LIGHT EMITTING APPARATUS USING AC LED

(75) Inventors: Keon Young Lee, Gyeonggi-do (KR); Choong Hae Lee, Seoul (KR)

(73) Assignee: Kwangsung Electronic Industry Co., Ltd., Incheon-si (KR)

( * ) Notice: Subject to any disclaimer, the term of this patent is extended or adjusted under 35 U.S.C. 154(b) by 279 days.

(21) Appl. No.: 12/945,295

(22) Filed: Nov. 12, 2010

(65) Prior Publication Data

US 2012/0001568 A1 Jan. 5, 2012

(30) Foreign Application Priority Data

Jul. 5, 2010 (KR) ..... 10-2010-0064344

(51) Int. Cl.
*H05B 37/02* (2006.01)

(52) U.S. Cl.
USPC ..... 315/188

(58) Field of Classification Search
USPC ..... 315/291, 200, 185, 250, 82, 205, 171, 315/174, 176, 185 R, 185 S, 188
See application file for complete search history.

(56) References Cited

U.S. PATENT DOCUMENTS 3,679,935 A * 7/1972 Jacques et al. ..... 315/201
3,912,966 A * 10/1975 Harnden, Jr. ..... 315/46
5,463,280 A * 10/1995 Johnson ..... 315/187
6,078,148 A * 6/2000 Hochstein ..... 315/291
2006/0221606 A1* 10/2006 Dowling ..... 362/217
2007/0273299 A1* 11/2007 Miskin et al. ..... 315/250
2008/0106212 A1* 5/2008 Yen et al. ..... 315/192
2008/0211421 A1* 9/2008 Lee et al. ..... 315/250
2008/0247205 A1* 10/2008 Wu ..... 363/126

FOREIGN PATENT DOCUMENTS

KR 100861252 B1 * 10/2008
WO WO2006/095949 A1 * 9/2006

* cited by examiner

*Primary Examiner* — Daniel Cavallari
*Assistant Examiner* — Christine Johnson
(74) *Attorney, Agent, or Firm* — Rabin & Berdo, P.C.

(57) ABSTRACT

Provided is an AC LED light emitting device. The AC LED light emitting device flows a current to at least one AC LED array among at least two AC LED arrays of an AC LED light emitting unit to turn it on during one period of an AC power having sine wave characteristics if a magnitude of a voltage applied to the AC LED light emitting unit including at least two AC LED arrays each of which including at least one AC LED is smaller than a turn-on voltage determined according to the number of AC LED arrays of the AC LED light emitting unit. If the magnitude of the voltage applied to the AC LED light emitting unit is larger than the turn-on voltage of the AC LED light emitting unit, all of the AC LED arrays of the AC LED light emitting unit are turned on.

10 Claims, 8 Drawing Sheets

LIGHT EMITTING APPARATUS USING AC LED

BACKGROUND OF THE INVENTION

The present invention disclosed herein relates to a light emitting device using an alternating current (AC) light emitting diode (LED), and more particularly, to a light emitting device using an AC LED which turns on at least one AC LED array in an AC LED light emitting unit including at least two AC LED arrays each of which includes at least one AC LED within one period of an AC power (e.g., AC 110V, AC 220V, or the like).

Generally, for an AC LED light emitting device adopting an AC LED light emitting unit, which includes at least two AC LED arrays each of which includes at least one AC LED, as a light source, a voltage of an AC power such as an AC 110V or AC 220V is decreased to a driving voltage and supplied to the AC LED light emitting unit.

FIG. 1 is a diagram illustrating a conventional AC LED light emitting device.

The conventional AC LED light emitting device illustrated in FIG. 1 decreases a voltage of an AC power (e.g., AC 110V, AC 220V, or the like) to a driving voltage using a resistor and supplies the driving voltage to an AC LED light emitting unit.

Referring to FIG. 1, the conventional AC LED light emitting device 100 includes an AC power unit 110, an AC LED light emitting unit 120, and a voltage dropping unit 130.

The AC power unit 110 provides the AC power such as the AC 110V or AC 220V through power output terminals L1 and L2.

The AC LED light emitting unit 120 includes a first AC LED light emitting unit 121 and a second AC LED light emitting unit 122. The first AC LED light emitting unit 121 includes at least two AC LED arrays connected to each other in series, where each AC LED array includes at least one AC LED connected in a forward direction to the terminal L1 of the AC power unit 110. The first AC LED light emitting unit 121 is turned on when a phase of a voltage V1 of the AC power is positive. The second AC LED light emitting unit 122 includes at least two AC LED arrays connected to each other in series, where each AC LED array includes at least one AC LED connected in a forward direction to the terminal L2 of the AC power unit 110. The second AC LED light emitting unit 122 is connected in parallel to the first AC LED light emitting unit 121. The second AC LED light emitting unit 122 is turned on when the phase of the voltage V1 of the AC power is negative.

For reference, it is exemplarily illustrated in FIG. 1 that the first AC LED light emitting unit 121 includes 4 AC LED arrays LED1, LED3, LED5, and LED7 connected to each other in series, where each AC LED array includes at least one AC LED connected in a forward direction to the terminal L1 of the AC power unit 110. Also, it is exemplarily illustrated that the second AC LED light emitting unit 122 includes 4 AC LED arrays LED2, LED4, LED6, and LED 8 connected to each other in series, where each AC LED array includes at least one AC LED connected in a forward direction to the terminal L2 of the AC power unit 110, being connected in parallel to the first AC LED light emitting unit 121.

The voltage dropping unit 130 includes a first resistor R1 installed between the terminal L1 of the AC power unit 110 and the AC LED light emitting unit 120 for dropping a voltage and a second resistor R2 installed between the terminal L2 of the AC power unit 110 and the AC LED light emitting unit 120 for dropping a voltage. The voltage dropping unit 130 drops the voltage V1 of the AC power to the driving voltage and supplies the driving voltage to the AC LED light emitting unit 120.

The first resistor R1 drops the voltage V1 of the AC power to the driving voltage and supplies the driving voltage to the first AC LED light emitting unit 121 when the phase of the voltage V1 of the AC power is positive.

The second resistor R2 drops the voltage V1 of the AC power to the driving voltage and supplies the driving voltage to the second AC LED light emitting unit 122 when the phase of the voltage V1 of the AC power is negative.

The voltage dropping unit 130 may further include a Positive Temperature Coefficient Resistor (PTCR) between the AC power unit 110 and the AC LED light emitting unit 120. The PTCR is capable of controlling a current applied to the AC LED light emitting unit 120 according to a change of temperature of the AC LED light emitting unit 120.

It is preferable to connect the PTCR in parallel to the first resistor R1 as illustrated in FIG. 1. The PTCR decreases the current applied to the AC LED light emitting unit 120 if the temperature increases due to turn-on of the AC LED light emitting unit 120.

An operation of the AC LED light emitting device 100 is described as follows.

When the phase of the voltage V1 of the AC power such as AC 110V or AC 220V provided by the AC power unit 110 is positive, the 4 AC LED arrays LED1, LED3, LED5, and LED7 of the first AC LED light emitting unit 121 including at least one AC LED connected to each other in series and connected in a forward direction to the terminal L1 of the AC power unit 110 are turned on by the driving voltage supplied through the first resistor R1. At this time, the second AC LED light emitting unit 122 connected in parallel to the first AC LED light emitting unit 121 in a reverse direction is not turned on.

On the contrary, when the phase of the voltage V1 of the AC power is negative, the 4 AC LED arrays LED2, LED4, LED6, and LED8 of the second AC LED light emitting unit 122 including at least one AC LED connected to each other in series and connected in a forward direction to the terminal L2 of the AC power unit 110 are turned on by the driving voltage supplied through the second resistor R2. At this time, the first AC LED light emitting unit 121 connected in parallel to the second AC LED light emitting unit 122 in a reverse direction is not turned on.

FIG. 2 is a diagram illustrating another conventional AC LED light emitting device. A size of the AC LED light emitting unit 120 including two AC LED light emitting units 121 and 122 illustrated in FIG. 1 is reduced to a half. That is, two AC LED light emitting units are reduced to one, and one AC LED light emitting unit is connected in a forward direction to the AC power regardless of polarity of the AC power by using a diode bridge.

The conventional AC LED light emitting device of FIG. 2 drops the voltage of the AC power to the driving voltage of the AC LED light emitting unit using the resistor, and then, full-wave rectifies the driving voltage through the diode bridge which connects the AC LED light emitting unit in a forward direction to the AC power regardless of the polarity of the AC power to supply the rectified driving voltage to the AC LED light emitting unit.

Referring to FIG. 2, the conventional AC LED light emitting device 200 includes an AC power unit 210, an AC LED light emitting unit 220, a voltage dropping unit 230, and a diode bridge 240.

The AC power unit 210 provides the AC power such as the AC 110V or AC 220V through power output terminals L1 and L2.

The AC LED light emitting unit 220 includes at least two AC LED arrays connected to each other in series, where each AC LED array includes at least one AC LED connected in a forward direction to the AC power. The AC LED light emitting unit 220 is turned on when the phase of the voltage V1 of the AC power is positive or negative.

For reference, it is exemplarily illustrated in FIG. 2 that the AC LED light emitting unit 220 includes 4 AC LED arrays LED1 to LED4 connected to each other in series, where each AC LED array includes at least one AC LED connected in a forward direction to the AC power.

The voltage dropping unit 230 includes a first resistor R1 installed between the terminal L1 of the AC power unit 210 and the AC LED light emitting unit 220 for dropping a voltage and a second resistor R2 installed between the terminal L2 of the AC power unit 210 and the AC LED light emitting unit 220 for dropping a voltage. The voltage dropping unit 230 drops the voltage V1 of the AC power to the driving voltage and supplies the driving voltage to the AC LED light emitting unit 220.

The first resistor R1 drops the voltage V1 of the AC power to the driving voltage and supplies the driving voltage to the AC LED light emitting unit 220 when the phase of the voltage V1 of the AC power is positive.

The second resistor R2 drops the voltage V1 of the AC power to the driving voltage and supplies the driving voltage to the AC LED light emitting unit 220 when the phase of the voltage V1 of the AC power is negative.

The voltage dropping unit 230 may further include a PTCR between the AC power unit 210 and the AC LED light emitting unit 220. The PTCR is capable of controlling a current applied to the AC LED light emitting unit 220 according to a change of temperature of the AC LED light emitting unit 220.

It is preferable to connect the PTCR in parallel to the first resistor R1 as illustrated in FIG. 2. The PTCR decreases the current applied to the AC LED light emitting unit 220 if the temperature increases due to turn-on of the AC LED light emitting unit 220.

The diode bridge 240 is a full-wave rectifying circuit where four diodes are connected in a rhombus shape forming a positive connection node N1, a negative connection node N2 facing the positive connection node N2, and a pair of input/output nodes N3 and N4 facing each other between the positive connection node N1 and the negative connection node N2. The diode bridge 240 connects the AC LED light emitting unit 220 in a forward direction to the AC power regardless of the polarity of the AC power and full-wave rectifies the driving voltage supplied through the voltage dropping unit 230 to supply the rectified driving voltage to the AC LED light emitting unit 220.

The first resistor R1 of the voltage dropping unit 230 is connected to the positive connection node N1 of the diode bridge 240, and the second resistor R2 of the voltage dropping unit 230 is connected to the negative connection node N2. The AC LED light emitting unit 220 is connected in a forward direction to the AC power unit 210 between the pair of the input/output nodes N3 and N4.

The diode bridge 240 full-wave rectifies the driving voltage supplied through the first resistor R1 of the voltage dropping unit 230 and supplies the rectified driving voltage to the AC LED light emitting unit 220 when the phase of the voltage V1 of the AC power is positive.

The diode bridge 240 full-wave rectifies the driving voltage supplied through the second resistor R2 of the voltage dropping unit 230 and supplies the rectified driving voltage to the AC LED light emitting unit 220 when the phase of the voltage V1 of the AC power is negative.

An operation of the conventional AC LED light emitting device 200 is described as follows.

When the phase of the voltage V1 of the AC power such as AC 110V or AC 220V provided by the AC power unit 210 is positive, the 4 AC LED arrays LED1 to LED4 of the AC LED light emitting unit 220 including at least one AC LED connected to each other in series and connected in a forward direction to the terminal L1 of the AC power unit 210 are turned on by the driving voltage supplied after being full-wave rectified through the first resistor R1 and the diode bridge 240. At this time, the current flows through the positive connection node N1, the input/output node N3, the 4 AC LED arrays LED1 to LED4 of the AC LED light emitting unit 220, the input/output node N4, and the negative connection node N2 shown in FIG. 2.

On the contrary, when the phase of the voltage V1 of the AC power is negative, the 4 AC LED arrays LED1 to LED4 of the AC LED light emitting unit 220 including at least one AC LED connected to each other in series and connected in a forward direction to the terminal L1 of the AC power unit 210 are turned on by the driving voltage supplied after being full-wave rectified through the second resistor R2 and the diode bridge 240. At this time, the current flows through the negative connection node N2, the input/output node N3, the 4 AC LED arrays LED1 to LED4 of the AC LED light emitting unit 220, the input/output node N4, and the positive connection node N1.

Meanwhile, the AC power such as the AC 110V or AC 220V supplied to the above-described conventional AC LED light emitting devices 100 and 200 shows since wave characteristics having a positive polarity at a phase of 0° to 180° and a negative polarity at a phase of 180° to 360° within one period with a frequency of generally 60 Hz as illustrated in FIG. 3A.

Also, according to the conventional AC LED light emitting devices 100 and 200, as the number of the AC LED arrays included in the AC LED light emitting units 120 and 220 connected in a forward direction to the AC power such as the AC 110V or AC 220V is increased, a turn-on voltage, i.e., a forward threshold voltage, is increased. Only when magnitude of the voltage applied to the AC LED light emitting units 120 and 220 is larger than the turn-on voltage, the current flows to the AC LED light emitting units 120 and 220 so that they are turned on. Herein, the current applied to the AC LED light emitting units 120 and 220 flows to the AC LED light emitting units 120 and 220 only when the magnitude of the voltage is larger than the turn-on voltage at the phase of 0° to 180° where the phase of the voltage V1 of the AC power is positive as illustrated in FIG. 3B. Also, the current flows to the AC LED light emitting units 120 and 220 only when the magnitude of the voltage is larger than the turn-on voltage at the phase of 180° to 360° where the phase of the voltage V1 of the AC power is negative.

Actually, at the phase of 0° to 180° where the phase of the voltage V1 of the AC power showing the sine wave characteristics is positive, if it is assumed that a time taken for the magnitude of the voltage to reach the turn-on voltage is t1, a time where the magnitude of the voltage is kept as higher than the turn-on voltage is t2, and a time where the magnitude of the voltage drops below the turn-on voltage again is t3, the current applied to the AC LED light emitting units 120 and 220 flows to the AC LED light emitting units 120 and 220 only during the time t2. Herein, the time t1 corresponds to a phase of approximately 0° to 45° where the phase of the voltage V1 of the AC power is positive, the time t2 corresponds to a phase of approximately 45° to 135° where the phase of the voltage V1 of the AC power is positive, and the time t3 corresponds to a phase of approximately 135° to 180° where the phase of the voltage V1 of the AC power is positive.

Also, at the phase of 180° to 360° where the phase of the voltage V1 of the AC power is negative, if it is assumed that that a time taken for the magnitude of the voltage to reach the turn-on voltage is t4, a time where the magnitude of the voltage is kept as higher than the turn-on voltage is t5, and a time where the magnitude of the voltage drops below the turn-on voltage again is t6, the current applied to the AC LED light emitting units 120 and 220 flows to the AC LED light emitting units 120 and 220 only during the time t5. Herein, the time t4 corresponds to a phase of approximately 180° to 225° where the phase of the voltage V1 of the AC power is negative, the time t5 corresponds to a phase of approximately 225° to 315° where the phase of the voltage V1 of the AC power is negative, and the time t6 corresponds to a phase of approximately 315° to 360° where the phase of the voltage V1 of the AC power is negative.

However, according to the conventional AC LED light emitting devices 100 and 200, as illustrated in FIG. 3B, in one period of the phase of the voltage of the AC power having the sinusoidal characteristics, if the current is applied to the AC LED light emitting units 120 and 220 only during the time t2 corresponding to the phase of approximately 45° to 135° where the phase of the voltage V1 of the AC power is positive and the time t5 corresponding to the phase of approximately 225° to 315° where the phase of the voltage V1 of the AC power is negative, lighting efficiency of the AC LED light emitting units 120 and 220 is degraded and power consumption is increased. Further, due to discontinuity of the operating current, a Total Harmonic Distortion (THD) is high having approximately 40% to 50%, and a flicker occurs excessively.

SUMMARY OF THE INVENTION

The present invention provides an AC LED light emitting device which flows a current to at least one AC LED array among at least two AC LED arrays of an AC LED light emitting unit to turn it on during one period of an AC power having sine wave characteristics if a magnitude of a voltage applied to the AC LED light emitting unit including at least two AC LED arrays each of which including at least one AC LED is smaller than a turn-on voltage determined according to the number of AC LED arrays of the AC LED light emitting unit, and if the magnitude of the voltage applied to the AC LED light emitting unit is larger than the turn-on voltage of the AC LED light emitting unit, all of the AC LED arrays of the AC LED light emitting unit are turned on.

Embodiments of the present invention provide AC LED light emitting devices including an AC power unit configured to provide an AC power through a first power output terminal and a second power output terminal; an AC LED light emitting unit including a first AC LED light emitting unit and a second AC LED light emitting unit connected in parallel to the first AC LED light emitting unit, wherein the first AC LED light emitting unit includes at least two AC LED arrays, which are connected to each other in series and each of which includes at least one AC LED connected in a forward direction to the first power output terminal, and is turned on when a phase of a voltage of the AC power is positive, and the second AC LED light emitting unit includes at least two AC LED arrays, which are connected to each other in series and each of which includes at least one AC LED connected in a forward direction to the second power output terminal, and is turned on when the phase of the voltage of the AC power is negative; a voltage dropping unit configured to drop the voltage of the AC power to a driving voltage of the AC LED light emitting unit and supply the driving voltage including a first resistor installed between the first power output terminal and the AC LED light emitting unit and a second resistor installed between the second power output terminal and the AC LED light emitting unit; a first turn-on switch unit including a third resistor and a first condenser connected to each other in series, wherein one terminal of the third resistor is connected to the first power output terminal and one terminal of the first condenser is connected to an anode of an AC LED array whose cathode is directly connected to the second resistor among the at least two AC LED arrays of the first AC LED light emitting unit, and while the first condenser sequentially repeats processes of charging, charging stop, and discharging when the phase of the voltage of the AC power is positive, the first turn-on switch unit flows a current to the AC LED array whose cathode is directly connected to the second resistor to turn it on during the charging and discharging processes; and a second turn-on switch unit including a fourth resistor and a second condenser connected to each other in series, wherein one terminal of the fourth resistor is connected to the second power output terminal and one terminal of the second condenser is connected to an anode of an AC LED array whose cathode is directly connected to the first resistor among the at least two AC LED arrays of the second AC LED light emitting unit, and while the second condenser sequentially repeats processes of charging, charging stop, and discharging when the phase of the voltage of the AC power is negative, the second turn-on switch unit flows a current to the AC LED array whose cathode is directly connected to the first resistor to turn it on during the charging and discharging processes.

In other embodiments of the present invention, AC LED light emitting devices include an AC power unit configured to provide an AC power through a first power output terminal and a second power output terminal; an AC LED light emitting unit configured to be turned on when a phase of a voltage of the AC power is positive or negative including at least two AC LED arrays which are connected to each other in series and each of which includes at least one AC LED connected in a forward direction to the first power output terminal; a voltage dropping unit configured to drop the voltage of the AC power to a driving voltage of the AC LED light emitting unit and supply the driving voltage including a first resistor installed between the first power output terminal and the AC LED light emitting unit and a second resistor installed between the second power output terminal and the AC LED light emitting unit; at least two diode bridges connected to each other in series and configured to connect each of the AC LED array of the AC LED light emitting unit in a forward direction to the AC power regardless of polarity of the AC power and full-wave rectify the driving voltage supplied through the voltage dropping unit to supply the rectified driving voltage to each of the AC LED array of the AC LED light emitting unit, wherein each of the at least two diode bridges is a full-wave rectifying circuit where four diodes are connected in a rhombus shape forming a positive connection node, a negative connection node facing the positive connection node, and a pair of input/output nodes facing each other between the positive connection node and the negative connection node; a first turn-on switch unit including a third resistor and a first condenser connected to each other in series, wherein one terminal of the third resistor is connected to the first power output terminal and one terminal of the first condenser is connected to a diode bridge directly connected to the second resistor among the at least two diode bridges, and while the first condenser sequentially repeats processes of charging, charging stop, and discharging when the phase of the voltage of the AC power is positive, the first turn-on switch unit flows a current to an AC LED array of the AC LED light emitting unit, for which the diode bridge directly connected to the second resistor full-wave rectifies the driving voltage and supplies the rectified driving voltage, to turn it on during the charging and discharging processes; and a second turn-on switch unit including a fourth resistor and a second condenser connected to each other in series, wherein one terminal of the fourth resistor is connected to the second power output terminal and one terminal of the second condenser is connected to a diode bridge directly connected to the first resistor among the at least two diode bridges, and while the second condenser sequentially repeats processes of charging, charging stop, and discharging when the phase of the voltage of the AC power is negative, the second turn-on switch unit flows a current to an AC LED array of the AC LED light emitting unit, for which the diode bridge directly connected to the first resistor full-wave rectifies the driving voltage and supplies the rectified driving voltage, to turn it on during the charging and discharging processes.

In some embodiments, one terminal of the third resistor is connected to the first resistor, and while the first condenser sequentially repeats processes of charging, charging stop, and discharging by an output voltage of the first resistor, the first turn-on switch unit may flow the current to the AC LED array of the AC LED light emitting unit, for which the diode bridge directly connected to the second resistor full-wave rectifies the driving voltage and supplies the rectified driving voltage, to turn it on during the charging and discharging processes.

In other embodiments, one terminal of the fourth resistor is connected to the second resistor, and while the second condenser sequentially repeats processes of charging, charging stop, and discharging by an output voltage of the second resistor, the second turn-on switch unit may flow the current to the AC LED array of the AC LED light emitting unit, for which the diode bridge directly connected to the first resistor full-wave rectifies the driving voltage and supplies the rectified driving voltage, to turn it on during the charging and discharging processes.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

[Embodiment 1]

Figure 4:
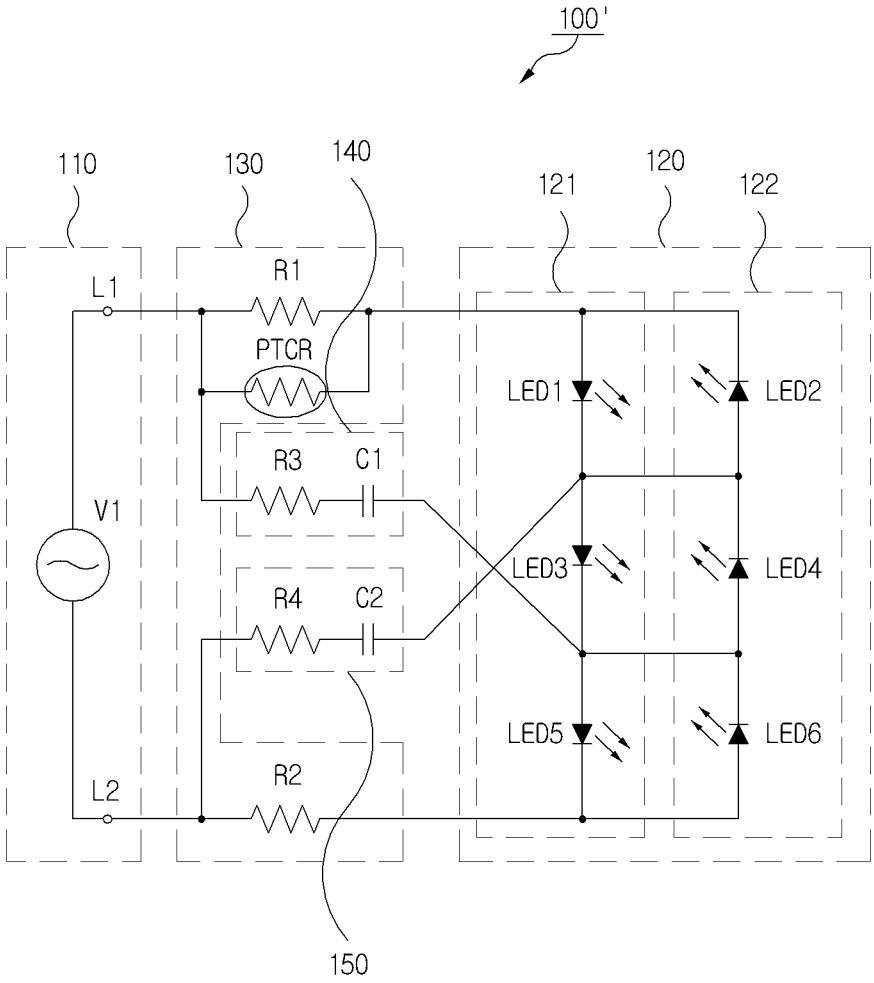
FIG. 4 is a diagram illustrating an AC LED light emitting device according to a first embodiment of the present invention.

FIG. 4 is a diagram illustrating an alternating current (AC) light emitting diode (LED) light emitting device according to a first embodiment of the present invention.

Figure 1:
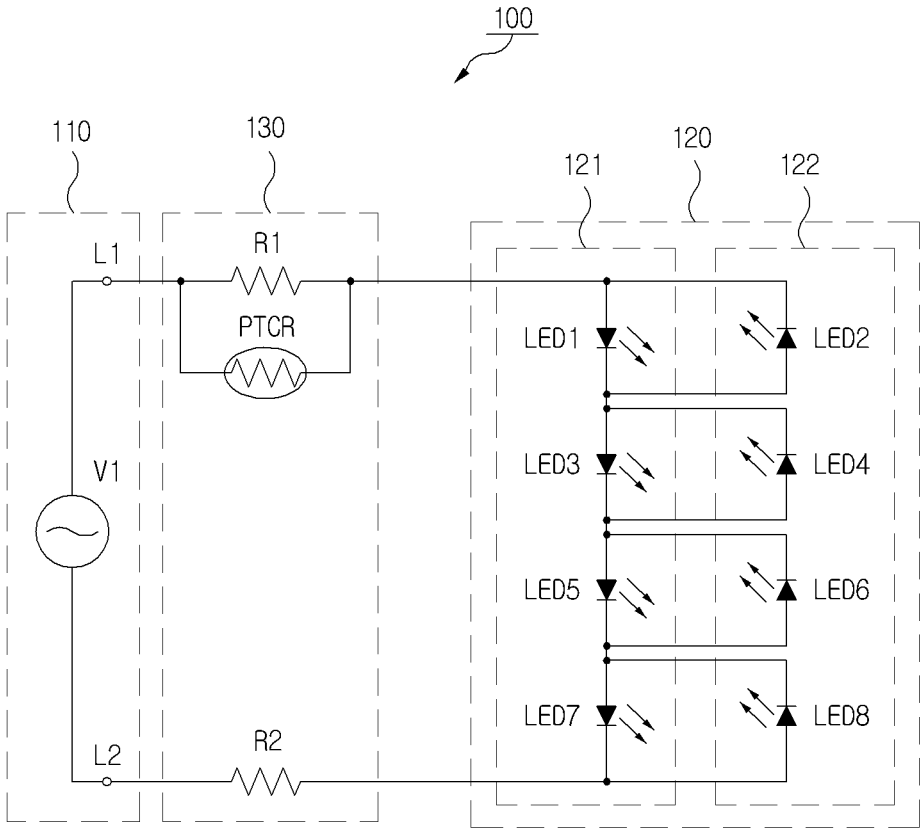
FIG. 1 PRIOR ART
FIG. 1 is a diagram illustrating a conventional AC LED light emitting device.

An AC LED light emitting device 100' according to the first embodiment of the present invention decreases a voltage of an AC power (e.g., AC 110V, AC 220V, or the like) to a driving voltage using a resistor and supplies the driving voltage to an AC LED light emitting unit like the conventional AC LED light emitting device 100 illustrated in FIG. 1.

Referring to FIG. 4, the AC LED light emitting device 100' includes an AC power unit 110, an AC LED light emitting unit 120, a voltage dropping unit 130, a first turn-on switch unit 140, and a second turn-on switch unit 150.

The AC power unit 110 provides the AC power such as the AC 110V or AC 220V through power output terminals L1 and L2.

The AC LED light emitting unit 120 includes a first AC LED light emitting unit 121 and a second AC LED light emitting unit 122. The first AC LED light emitting unit 121 includes at least two AC LED arrays connected to each other in series, where each AC LED array includes at least one AC LED connected in a forward direction to the terminal L1 of the AC power unit 110. The first AC LED light emitting unit 121 is turned on when a phase of a voltage V1 of the AC power is positive. The second AC LED light emitting unit 122 includes at least two AC LED arrays connected to each other in series, where each AC LED array includes at least one AC LED connected in a forward direction to the terminal L2 of the AC power unit 110. The second AC LED light emitting unit 122 is connected in parallel to the first AC LED light emitting unit 121. The second AC LED light emitting unit 122 is turned on when the phase of the voltage V1 of the AC power is negative.

For reference, it is exemplarily illustrated in FIG. 4 that the first AC LED light emitting unit 121 includes 3 AC LED arrays LED1, LED3, and LED5 connected to each other in series, where each AC LED array includes at least one AC LED connected in a forward direction to the terminal L1 of the AC power unit 110. Also, it is exemplarily illustrated that the second AC LED light emitting unit 122 includes 3 AC LED arrays LED2, LED4, and LED6 connected to each other in series, where each AC LED array includes at least one AC LED connected in a forward direction to the terminal L2 of the AC power unit 110, being connected in parallel to the first AC LED light emitting unit 121.

The voltage dropping unit 130 includes a first resistor R1 installed between the terminal L1 of the AC power unit 110 and the AC LED light emitting unit 120 for dropping a voltage and a second resistor R2 installed between the terminal L2 of the AC power unit 110 and the AC LED light emitting unit 120 for dropping a voltage. The voltage dropping unit 130 drops the voltage V1 of the AC power to the driving voltage and supplies the driving voltage to the AC LED light emitting unit 120.

The first resistor R1 drops the voltage V1 of the AC power to the driving voltage and supplies the driving voltage to the first AC LED light emitting unit 121 when the phase of the voltage V1 of the AC power is positive.

The second resistor R2 drops the voltage V1 of the AC power to the driving voltage and supplies the driving voltage to the second AC LED light emitting unit 122 when the phase of the voltage V1 of the AC power is negative.

The voltage dropping unit 130 may further include a Positive Temperature Coefficient Resistor (PTCR) between the AC power unit 110 and the AC LED light emitting unit 120. The PTCR is capable of controlling a current applied to the AC LED light emitting unit 120 according to a change of temperature of the AC LED light emitting unit 120.

It is preferable to connect the PTCR in parallel to the first resistor R1 as illustrated in FIG. 4. The PTCR decreases the current applied to the AC LED light emitting unit 120 if the temperature increases due to turn-on of the AC LED light emitting unit 120.

The first turn-on switch unit 140 includes a resistor R3 and a condenser C1 connected to each other in series. One terminal of the resistor R3 is connected to the terminal L1 of the AC power unit 110, and one terminal of the condenser C1 is connected to an anode of the AC LED array whose cathode is directly connected to the second resistor R2 of the voltage dropping unit 130 among the at least two AC LED arrays connected in series in the first AC LED light emitting unit 121.

While the condenser C1 sequentially repeats processes of charging, charging stop, and discharging when the voltage V1 of the AC power is positive, the first turn-on switch unit 140 flows a current to the AC LED array whose cathode is directly connected to the second resistor R2 of the voltage dropping unit 130 to turn it on during the processes of charging and discharging.

The condenser C1 repeats the process of charging, charging stop on completion of charging, and discharging when the voltage V1 of the AC power of the AC power unit 110 is positive. Herein, a charging time and a discharging time may be determined by adjusting a time constant determined by the resistor R3 and the condenser C1 connected to each other in series.

When the voltage V1 of the AC power of the AC power unit 110 is positive, even though a magnitude of a voltage applied to the AC LED light emitting unit 120 is smaller than that of a turn-on voltage determined according to the number of AC LED arrays of the AC LED light emitting unit 120, the first turn-on switch unit 140 flows the current to the AC LED array whose cathode is directly connected to the second resistor R2 of the voltage dropping unit 130 among the at least two AC LED arrays of the AC LED light emitting unit 120 to turn it on during the processes of charging and discharging of the condenser C1.

In the case of FIG. 4, during the processes of charging and discharging of the condenser C1, among the 3 AC LED arrays LED1, LED3, and LED5, the AC LED array LED5 whose cathode is directly connected to the second resistor R2 of the voltage dropping unit 130 is turned on. Herein, after the condenser C1 starts to charge, impedance of the condenser C1 is low before completion of charging. Therefore, the current flows to the AC LED array LED5 whose cathode is directly connected to the second resistor R2 of the voltage dropping unit 130 among the 3 AC LED arrays LED1, LED3, and LED5 so that only the LED5 is turned on. If charging is completed, the impedance of the condenser C1 becomes high blocking the current flow, and at the same time, the current flows through the first resistor R1 of the voltage dropping unit 130 and the 3 AC LED arrays LED1, LED3, and LED5 so that all of the 3 AC LED arrays LED1, LED3, and LED5 are turned on. During the process of discharging after stop of charging, due to a charging voltage of the condenser C1, the current flows to the AC LED array LED5 whose cathode is directly connected to the second resistor R2 of the voltage dropping unit 130 among the 3 AC LED arrays LED1, LED3, and LED5 so that only the LED5 is turned on.

The second turn-on switch unit 150 includes a resistor R4 and a condenser C2 connected to each other in series. One terminal of the resistor R4 is connected to the terminal L2 of the AC power unit 110, and one terminal of the condenser C2 is connected to an anode of the AC LED array whose cathode is directly connected to the first resistor R1 of the voltage dropping unit 130 among the at least two AC LED arrays connected in series in the second AC LED light emitting unit 122.

While the condenser C2 sequentially repeats the processes of charging, charging stop, and discharging when the voltage V1 of the AC power is negative, the second turn-on switch unit 150 flows a current to the AC LED array whose cathode is directly connected to the first resistor R1 of the voltage dropping unit 130 to turn it on during the processes of charging and discharging.

The condenser C2 repeats the process of charging, charging stop on completion of charging, and discharging when the voltage V1 of the AC power of the AC power unit 110 is negative. Herein, a charging time and a discharging time may be determined by adjusting a time constant determined by the resistor R4 and the condenser C2 connected to each other in series.

When the voltage V1 of the AC power of the AC power unit 110 is negative, even though the magnitude of the voltage applied to the AC LED light emitting unit 120 is smaller than that of the turn-on voltage determined according to the number of AC LED arrays of the AC LED light emitting unit 120, the second turn-on switch unit 150 flows the current to the AC LED array whose cathode is directly connected to the first resistor R1 of the voltage dropping unit 130 among the at least two AC LED arrays of the AC LED light emitting unit 120 to turn it on during the processes of charging and discharging of the condenser C2.

In the case of FIG. 4, during the processes of charging and discharging of the condenser C2, among the 3 AC LED arrays LED2, LED4, and LED6, the AC LED array LED2 whose cathode is directly connected to the first resistor R1 of the voltage dropping unit 130 is turned on. Herein, after the condenser C2 starts to charge, impedance of the condenser C2 is low before completion of charging. Therefore, the current flows to the AC LED array LED2 whose cathode is directly connected to the first resistor R1 of the voltage dropping unit 130 among the 3 AC LED arrays LED2, LED4, and LED6 so that only the LED2 is turned on. If charging is completed, the impedance of the condenser C2 becomes high blocking the current flow, and at the same time, the current flows through the second resistor R2 of the voltage dropping unit 130 and the 3 AC LED arrays LED2, LED4, and LED6 so that all of the 3 AC LED arrays LED2, LED4, and LED6 are turned on. During the process of discharging after stop of charging, due to a charging voltage of the condenser C2, the current flows to the AC LED array LED2 whose cathode is directly connected to the first resistor R2 of the voltage dropping unit 130 among the 3 AC LED arrays LED2, LED4, and LED6 so that only the LED2 is turned on.

An operation of the AC LED light emitting device 100' according to the first embodiment of the present invention is described as follows.

When the phase of the voltage V1 of the AC power such as AC 110V or AC 220V provided by the AC power unit 110 is positive, the 3 AC LED arrays LED1, LED3, and LED5 of the first AC LED light emitting unit 121 including at least one AC LED connected to each other in series and connected in a forward direction to the terminal L1 of the AC power unit 110 are turned on by the driving voltage supplied through the first resistor R1. At this time, the second AC LED light emitting unit 122 connected in parallel to the first AC LED light emitting unit 121 in a reverse direction is not turned on.

On the contrary, when the phase of the voltage V1 of the AC power is negative, the 3 AC LED arrays LED2, LED4, and LED6 of the second AC LED light emitting unit 122 including at least one AC LED connected to each other in series and connected in a forward direction to the terminal L2 of the AC power unit 110 are turned on by the driving voltage supplied through the second resistor R2. At this time, the first AC LED light emitting unit 121 connected in parallel to the second AC LED light emitting unit 122 in a reverse direction is not turned on.

Figure 5:
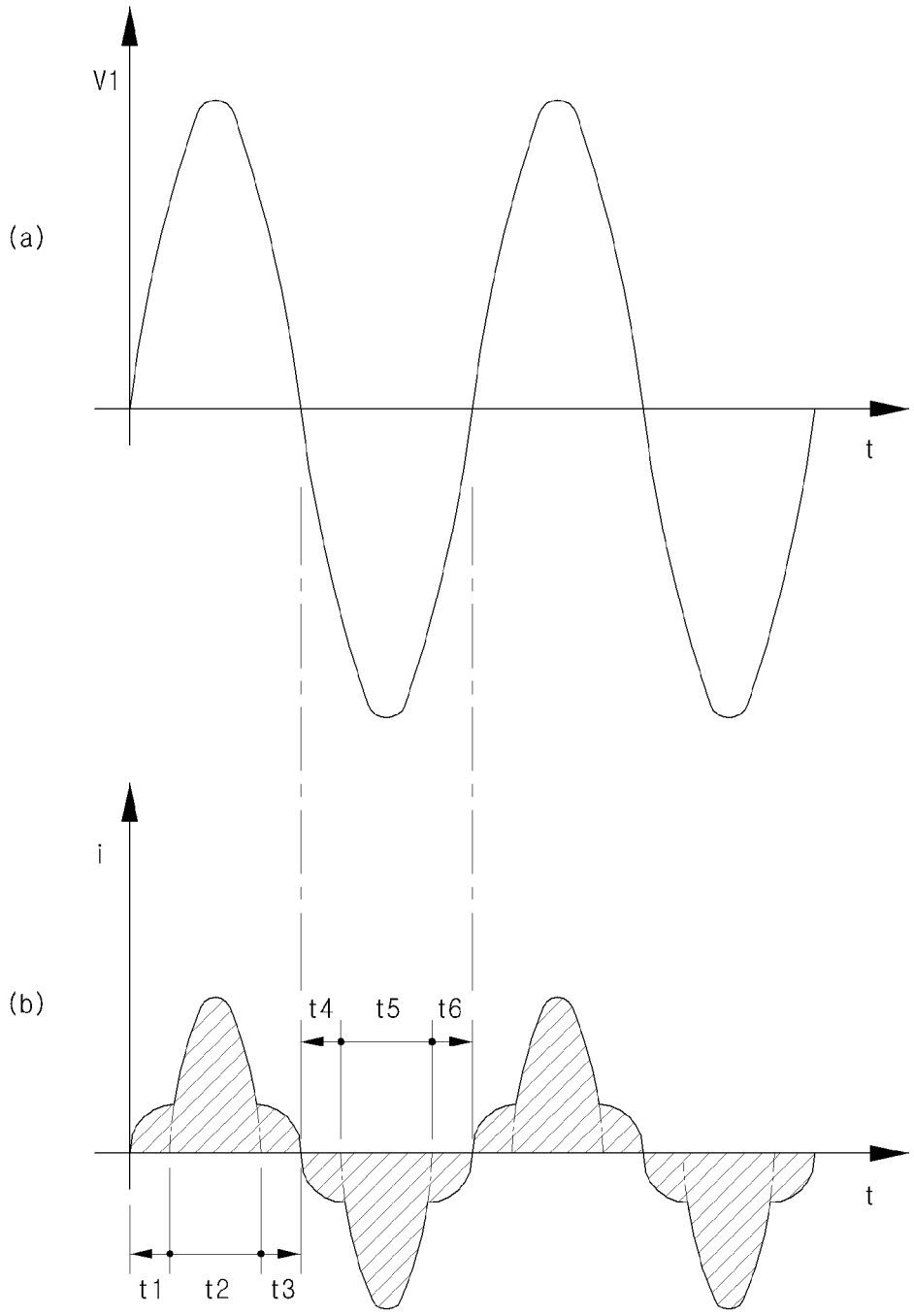
FIG. 5 is a graph illustrating voltage/current characteristics of the AC LED light emitting device according to the present invention.

Meanwhile, the AC power such as the AC 110V or AC 220V supplied to the AC LED light emitting devices 100' shows sine wave characteristics having a positive polarity at a phase of 0° to 180° and a negative polarity at a phase of 180° to 360° within one period with a frequency of generally 60 Hz as illustrated in FIG. 5A.

Also, if the magnitude of the voltage applied to the AC LED light emitting unit 120 including at least two AC LED arrays each of which including at least one AC LED is smaller than the turn-on voltage determined according to the number of AC LED arrays of the AC LED light emitting unit 120, the AC LED light emitting device 100' flows a current to at least one AC LED array among the at least two AC LED arrays of the AC LED light emitting unit 120 to turn it on during one period of the AC power such as the AC 110V or AC 220V. If the magnitude of the voltage applied to the AC LED light emitting unit 120 is larger than the turn-on voltage of the AC LED light emitting unit 120, all of the AC LED arrays of the AC LED light emitting unit 120 are turned on.

Actually, at the phase of 0° to 180° where the phase of the voltage V1 of the AC power showing the sine wave characteristics is positive, if it is assumed that a time taken for the magnitude of the voltage to reach the turn-on voltage of the AC LED light emitting unit 120 is t1, a time where the magnitude of the voltage is kept as higher than the turn-on voltage is t2, and a time where the magnitude of the voltage drops below the turn-on voltage again is t3, the time t1 corresponds to a phase of approximately 0° to 45° where the phase of the voltage V1 of the AC power is positive, the time t2 corresponds to a phase of approximately 45° to 135° where the phase of the voltage V1 of the AC power is positive, and the time t3 corresponds to a phase of approximately 135° to 180° where the phase of the voltage V1 of the AC power is positive.

Herein, as illustrated in FIG. 5B, in the case that the magnitude of the voltage applied to the AC LED light emitting unit 120 is lower than the turn-on voltage of the AC LED light emitting unit 120 at the phase of 0° to 180° where the phase of the voltage V1 of the AC power is positive, e.g., at the phase of approximately 0° to 45° and at the phase of approximately 135° to 180°, the current flows to the AC LED array LED5 whose cathode is directly connected to the second resistor R2 of the voltage dropping unit 130 among the 3 AC LED arrays LED1, LED3, and LED5 to turn it on.

At the phase of approximately 0° to 45°, the magnitude of the voltage applied to the AC LED array LED5 whose cathode is directly connected to the second resistor R2 of the voltage dropping unit 130 is larger than the turn-on voltage of the AC LED array LED5 during the process of charging of the condenser C1 and the impedance of the condenser C1 is low before completion of charging after charging is started. Therefore, the current flows to the AC LED array LED5 whose cathode is directly connected to the second resistor R2 of the voltage dropping unit 130 among the 3 AC LED arrays LED1, LED3, and LED5 illustrated in FIG. 4 so that only the LED5 is turned on.

At the phase of approximately 135° to 180°, during the process of discharging of the condenser C1, the magnitude of the charging voltage of the condenser C1, i.e., the magnitude of the voltage applied to the AC LED array LED5 whose cathode is directly connected to the second resistor R2 of the voltage dropping unit 130, is larger than the turn-on voltage of the AC LED array LED5. Therefore, the current flows to the AC LED array LED5 whose cathode is directly connected to the second resistor R2 of the voltage dropping unit 130 among the 3 AC LED arrays LED1, LED3, and LED5 illustrated in FIG. 4 so that only the LED5 is turned on.

Also, as illustrated in FIG. 5B, in the case that the magnitude of the voltage applied to the AC LED light emitting unit 120 is larger than the turn-on voltage of the AC LED light emitting unit 120 at the phase of 0° to 180° where the phase of the voltage V1 of the AC power is positive, e.g., at the phase of approximately 45° to 135°, if the charging process of the condenser C1 is completed, the impedance of the condenser C1 becomes high blocking the current flow, and at the same time, the current flows through the first resistor R1 of the voltage dropping unit 130 and the 3 AC LED arrays LED1, LED3, and LED5 so that all of the 3 AC LED arrays LED1, LED3, and LED5 are turned on.

On the contrary, at the phase of 180° to 360° where the phase of the voltage V1 of the AC power is negative, if it is assumed that that a time taken for the magnitude of the voltage to reach the turn-on voltage of the AC LED light emitting unit 120 is t4, a time where the magnitude of the voltage is kept as higher than the turn-on voltage is t5, and a time where the magnitude of the voltage drops below the turn-on voltage again is t6, the time t4 corresponds to a phase of approximately 180° to 225° where the phase of the voltage V1 of the AC power is negative, the time t5 corresponds to a phase of approximately 225° to 315° where the phase of the voltage V1 of the AC power is negative, and the time t6 corresponds to a phase of approximately 315° to 360° where the phase of the voltage V1 of the AC power is negative.

Herein, as illustrated in FIG. 5B, in the case that the magnitude of the voltage applied to the AC LED light emitting unit 120 is lower than the turn-on voltage of the AC LED light emitting unit 120 at the phase of 180° to 360° where the phase of the voltage V1 of the AC power is negative, e.g., at the phase of approximately 180° to 225° and at the phase of approximately 315° to 360°, the current flows to the AC LED array LED2 whose cathode is directly connected to the first resistor R1 of the voltage dropping unit 130 among the 3 AC LED arrays LED2, LED4, and LED6 to turn it on.

At the phase of approximately 180° to 225°, the magnitude of the voltage applied to the AC LED array LED2 whose cathode is directly connected to the first resistor R1 of the voltage dropping unit 130 is larger than the turn-on voltage of the AC LED array LED2 during the process of charging of the condenser C2 and the impedance of the condenser C2 is low before completion of charging after charging is started. Therefore, the current flows to the AC LED array LED2 whose cathode is directly connected to the first resistor R1 of the voltage dropping unit 130 among the 3 AC LED arrays LED2, LED4, and LED6 illustrated in FIG. 4 so that only the LED2 is turned on.

At the phase of approximately 315° to 360°, during the process of discharging of the condenser C2, the magnitude of the charging voltage of the condenser C2, i.e., the magnitude of the voltage applied to the AC LED array LED2 whose cathode is directly connected to the first resistor R1 of the voltage dropping unit 130, is larger than the turn-on voltage of the AC LED array LED2. Therefore, the current flows to the AC LED array LED2 whose cathode is directly connected to the first resistor R1 of the voltage dropping unit 130 among the 3 AC LED arrays LED2, LED4, and LED6 illustrated in FIG. 4 so that only the LED2 is turned on.

Also, as illustrated in FIG. 5B, in the case that the magnitude of the voltage applied to the AC LED light emitting unit 120 is larger than the turn-on voltage of the AC LED light emitting unit 120 at the phase of 180° to 360° where the phase of the voltage V1 of the AC power is negative, e.g., at the phase of approximately 315° to 360°, if the charging process of the condenser C2 is completed, the impedance of the condenser C2 becomes high blocking the current flow, and at the same time, the current flows through the second resistor R2 of the voltage dropping unit 130 and the 3 AC LED arrays LED2, LED4, and LED6 so that all of the 3 AC LED arrays LED2, LED4, and LED6 are turned on.

As described above, in the AC LED light emitting device 100' according to the first embodiment of the present invention, the current continuously flows to the AC LED light emitting unit 120 during the whole of one period of the AC power so that partial or all of the AC LED arrays are turned on. Accordingly, in comparison with the conventional AC LED light emitting device, lighting efficiency of the AC LED light emitting unit is high and power consumption is reduced. Further, due to continuity of the operating current, a Total Harmonic Distortion (THD) is decreased to approximately 10% to 25% and a flicker is remarkably reduced.

[Embodiment 2]

Figure 6:
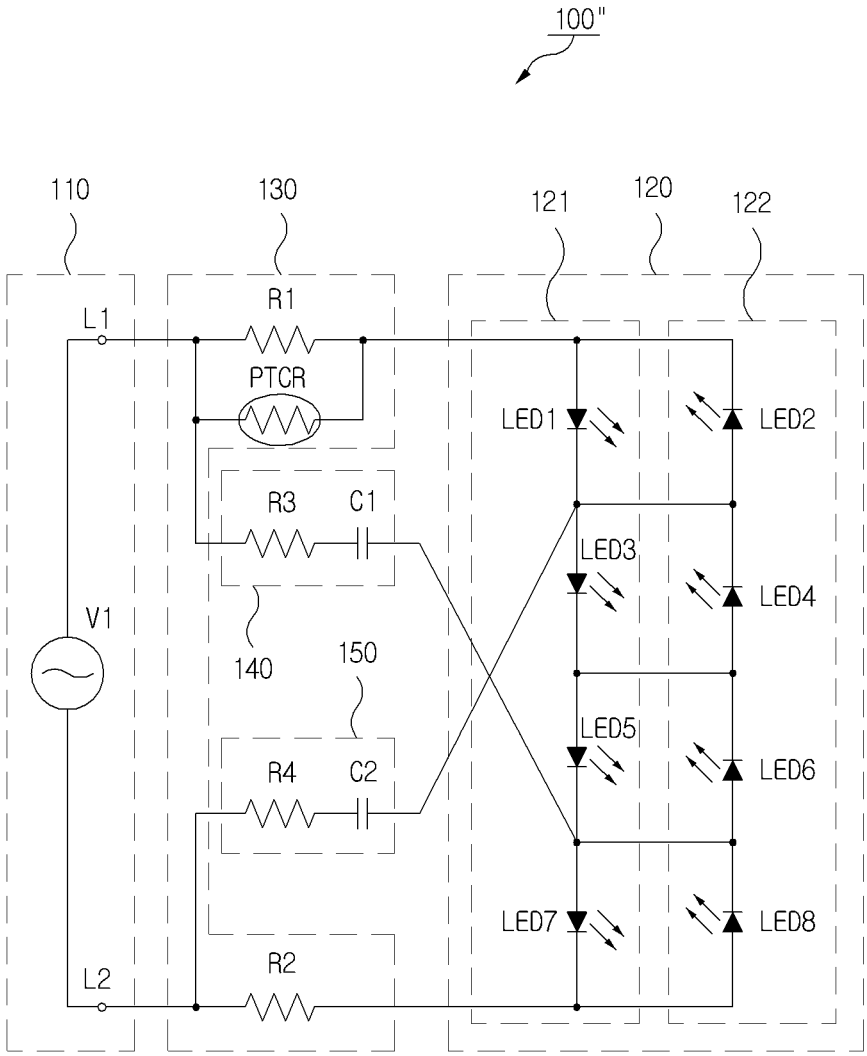
FIG. 6 is a diagram illustrating an AC LED light emitting device according to a second embodiment of the present invention.

FIG. 6 is a diagram illustrating an AC LED light emitting device according to a second embodiment of the present invention.

In comparison with the AC LED light emitting device 100' according to the first embodiment of the present invention, an AC LED light emitting device 100" according to the second embodiment of the present invention includes additional AC LED array for each of the first AC LED light emitting unit 121 and the second AC LED light emitting unit 122 and includes the same components, i.e., the AC power unit 110, the AC LED light emitting unit 120, the voltage dropping unit 130, the first turn-on switch unit 140, and the second turn-on switch unit 150.

In FIG. 6, it is exemplarily illustrated that the first AC LED light emitting unit 121 includes 4 AC LED arrays LED1, LED3, LED5, and LED7 connected to each other in series, where each AC LED array includes at least one AC LED connected in a forward direction to the terminal L1 of the AC power unit 110.

Also, it is exemplarily illustrated that the second AC LED light emitting unit 122 includes 4 AC LED arrays LED2, LED4, LED6, and LED8 connected to each other in series, where each AC LED array includes at least one AC LED connected in a forward direction to the terminal L2 of the AC power unit 110, being connected in parallel to the first AC LED light emitting unit 121.

Since the first AC LED light emitting unit 121 includes the 4 AC LED arrays LED1, LED3, LED5, and LED7 connected to each other in series and the second AC LED light emitting unit 122 includes the 4 AC LED arrays LED2, LED4, LED6, and LED8 connected to each other in series, the first turn-on switch unit 140 flows the current to the AC LED array LED7 whose cathode is directly connected to the second resistor R2 of the voltage dropping unit 130 to turn it on during the processes of charging and discharging of the condenser C1, and the second turn-on switch unit 150 flows the current to the AC LED array LED2 whose cathode is directly connected to the first resistor R1 of the voltage dropping unit 130 to turn it on during the processes of charging and discharging of the condenser C2.

An operation of the AC LED light emitting device 100" according to the first embodiment of the present invention is described as follows.

As illustrated in FIG. 5B, in the case that the magnitude of the voltage applied to the AC LED light emitting unit 120 is lower than the turn-on voltage of the AC LED light emitting unit 120 at the phase of 0° to 180° where the phase of the voltage V1 of the AC power is positive, e.g., at the phase of approximately 0° to 45° and at the phase of approximately 135° to 180°, the current flows to the AC LED array LED7 whose cathode is directly connected to the second resistor R2 of the voltage dropping unit 130 among the 4 AC LED arrays LED1, LED3, LED5, and LED7 to turn it on.

At the phase of approximately 0° to 45°, the magnitude of the voltage applied to the AC LED array LED7 whose cathode is directly connected to the second resistor R2 of the voltage dropping unit 130 is larger than the turn-on voltage of the AC LED array LED7 during the process of charging of the condenser C1 and the impedance of the condenser C1 is low before completion of charging after charging is started. Therefore, the current flows to the AC LED array LED7 whose cathode is directly connected to the second resistor R2 of the voltage dropping unit 130 among the 4 AC LED arrays LED1, LED3, LED5, and LED7 illustrated in FIG. 6 so that only the LED7 is turned on.

At the phase of approximately 135° to 180°, during the process of discharging of the condenser C1, the magnitude of the charging voltage of the condenser C1, i.e., the magnitude of the voltage applied to the AC LED array LED7 whose cathode is directly connected to the second resistor R2 of the voltage dropping unit 130, is larger than the turn-on voltage of the AC LED array LED7. Therefore, the current flows to the AC LED array LED7 whose cathode is directly connected to the second resistor R2 of the voltage dropping unit 130 among the 4 AC LED arrays LED1, LED3, LED5, and LED7 illustrated in FIG. 6 so that only the LED7 is turned on.

Also, as illustrated in FIG. 5B, in the case that the magnitude of the voltage applied to the AC LED light emitting unit 120 is larger than the turn-on voltage of the AC LED light emitting unit 120 at the phase of 0° to 180° where the phase of the voltage V1 of the AC power is positive, e.g., at the phase of approximately 45° to 135°, if the charging process of the condenser C1 is completed, the impedance of the condenser C1 becomes high blocking the current flow, and at the same time, the current flows through the first resistor R1 of the voltage dropping unit 130 and the 4 AC LED arrays LED1, LED3, LED5 and LED7 so that all of the 4 AC LED arrays LED1, LED3, LED5, and LED7 are turned on.

On the contrary, as illustrated in FIG. 5B, in the case that the magnitude of the voltage applied to the AC LED light emitting unit 120 is lower than the turn-on voltage of the AC LED light emitting unit 120 at the phase of 180° to 360° where the phase of the voltage V1 of the AC power is negative, e.g., at the phase of approximately 180° to 225° and at the phase of approximately 315° to 360°, the current flows to the AC LED array LED2 whose cathode is directly connected to the first resistor R1 of the voltage dropping unit 130 among the 4 AC LED arrays LED2, LED4, LED6, and LED8 to turn it on.

At the phase of approximately 180° to 225°, the magnitude of the voltage applied to the AC LED array LED2 whose cathode is directly connected to the first resistor R1 of the voltage dropping unit 130 is larger than the turn-on voltage of the AC LED array LED2 during the process of charging of the condenser C2 and the impedance of the condenser C2 is low before completion of charging after charging is started. Therefore, the current flows to the AC LED array LED2 whose cathode is directly connected to the first resistor R1 of the voltage dropping unit 130 among the 4 AC LED arrays LED2, LED4, LED6, and LED8 illustrated in FIG. 6 so that only the LED2 is turned on.

At the phase of approximately 315° to 360°, during the process of discharging of the condenser C2, the magnitude of the charging voltage of the condenser C2, i.e., the magnitude of the voltage applied to the AC LED array LED2 whose cathode is directly connected to the first resistor R1 of the voltage dropping unit 130, is larger than the turn-on voltage of the AC LED array LED2. Therefore, the current flows to the AC LED array LED2 whose cathode is directly connected to the first resistor R1 of the voltage dropping unit 130 among the 4 AC LED arrays LED2, LED4, LED6, and LED8 illustrated in FIG. 6 so that only the LED2 is turned on.

Also, as illustrated in FIG. 5B, in the case that the magnitude of the voltage applied to the AC LED light emitting unit 120 is larger than the turn-on voltage of the AC LED light emitting unit 120 at the phase of 180° to 360° where the phase of the voltage V1 of the AC power is negative, e.g., at the phase of approximately 225° to 315°, if the charging process of the condenser C2 is completed, the impedance of the condenser C2 becomes high blocking the current flow, and at the same time, the current flows through the second resistor R2 of the voltage dropping unit 130 and the 4 AC LED arrays LED2, LED4, LED6, and LED8 so that all of the 4 AC LED arrays LED2, LED4, LED6, and LED8 are turned on.

As described above, in the AC LED light emitting device 100" according to the second embodiment of the present invention, the current continuously flows to the AC LED light emitting unit 120 during the whole of one period of the AC power so that partial or all of the AC LED arrays are turned on. Accordingly, in comparison with the conventional AC LED light emitting device, the lighting efficiency of the AC LED light emitting unit is high and the power consumption is reduced. Further, due to continuity of the operating current, the THD is decreased to approximately 10% to 25% and the flicker is remarkably reduced.

[Embodiment 3]

Figure 7:
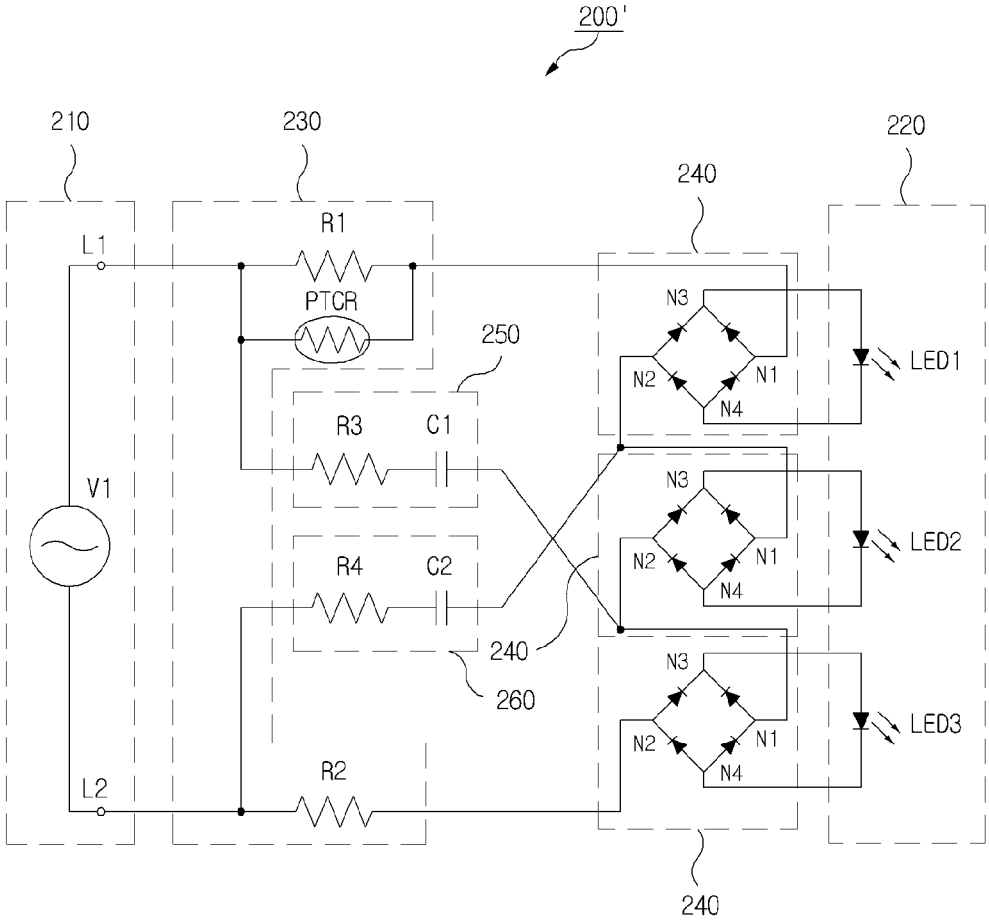
FIG. 7 is a diagram illustrating an AC LED light emitting device according to a third embodiment of the present invention.

FIG. 7 is a diagram illustrating an AC LED light emitting device according to a third embodiment of the present invention.

Figure 2:
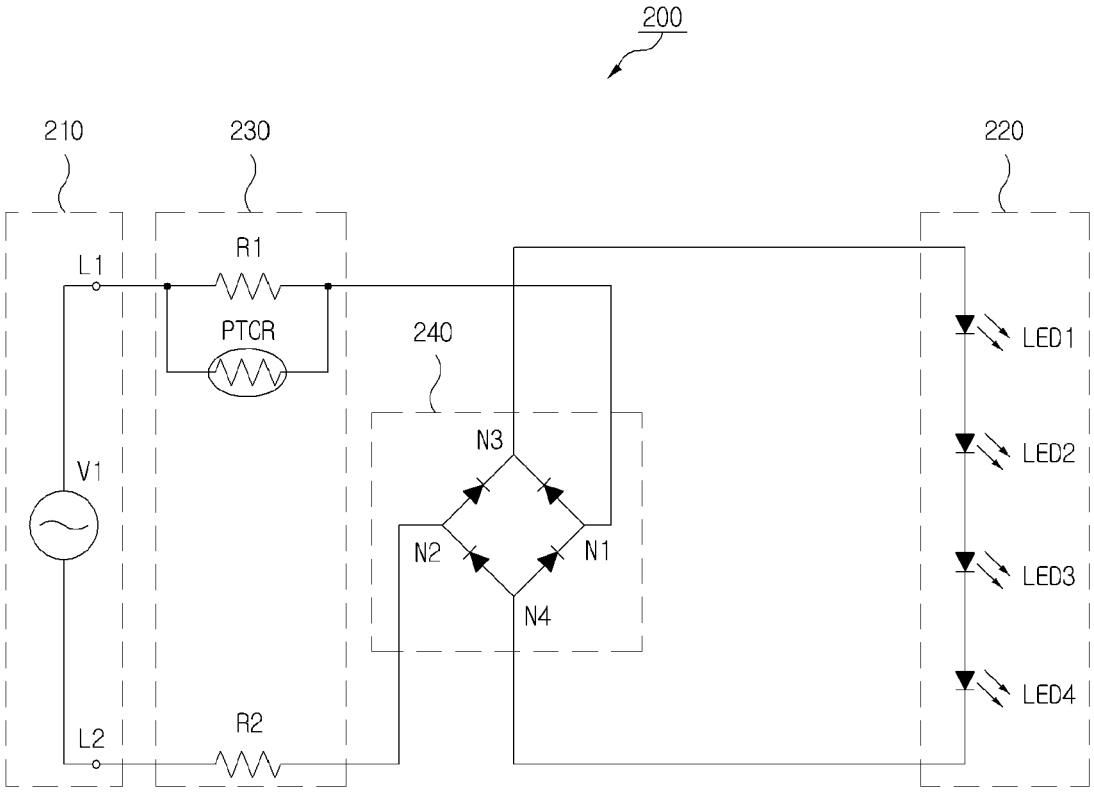
FIG. 2 PRIOR ART
FIG. 2 is a diagram illustrating another conventional AC LED light emitting device.
Figure 3:
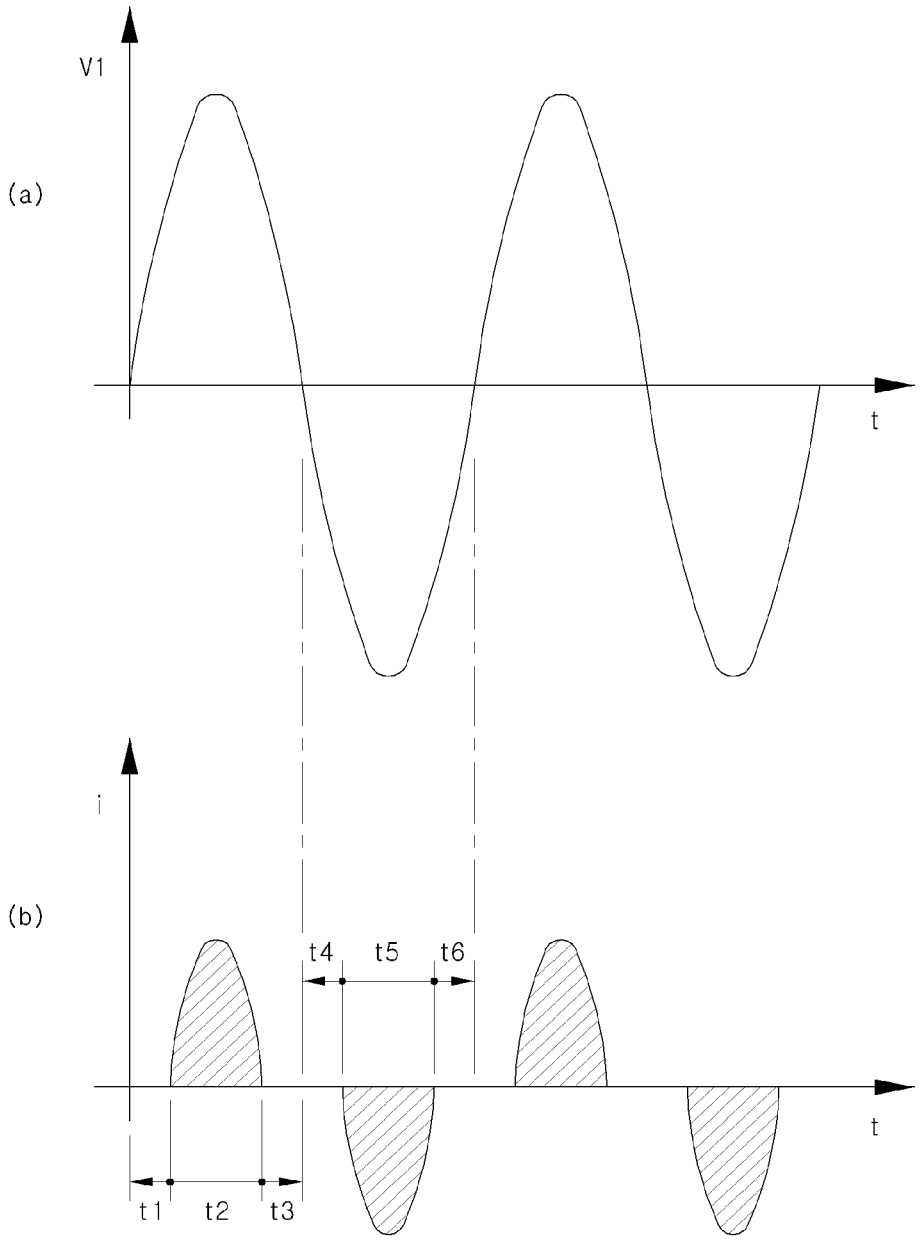
FIG. 3 PRIOR ART
FIG. 3 is a graph illustrating voltage/current characteristics of the conventional AC LED light emitting devices.

An AC LED light emitting device 200' according to the third embodiment of the present invention drops the voltage of the AC power to the driving voltage of the AC LED light emitting unit using the resistor, and then, full-wave rectifies the driving voltage through a diode bridge which connects the AC LED light emitting unit in a forward direction to the AC power regardless of the polarity of the AC power to supply the rectified driving voltage to the AC LED light emitting unit similarly to the conventional AC LED light emitting device 200 illustrated in FIG. 2.

Referring to FIG. 7, the AC LED light emitting device 200' includes an AC power unit 210, an AC LED light emitting unit 220, a voltage dropping unit 230, at least two diode bridges 240, a first turn-on switch unit 250, and a second turn-on switch unit 260.

The AC power unit 210 provides the AC power such as the AC 110V or AC 220V through power output terminals L1 and L2.

The AC LED light emitting unit 220 includes at least two AC LED arrays connected to each other in series, where each AC LED array includes at least one AC LED connected in a forward direction to the AC power. The AC LED light emitting unit 220 is turned on when the phase of the voltage V1 of the AC power is positive or negative.

For reference, it is exemplarily illustrated in FIG. 7 that the AC LED light emitting unit 220 includes 3 AC LED arrays LED1 to LED3 connected to each other in series, where each AC LED array includes at least one AC LED connected in a forward direction to the AC power.

The voltage dropping unit 230 includes a first resistor R1 installed between the terminal L1 of the AC power unit 210 and the AC LED light emitting unit 220 for dropping a voltage and a second resistor R2 installed between the terminal L2 of the AC power unit 210 and the AC LED light emitting unit 220 for dropping a voltage. The voltage dropping unit 230 drops the voltage V1 of the AC power to the driving voltage and supplies the driving voltage to the AC LED light emitting unit 220.

The first resistor R1 drops the voltage V1 of the AC power to the driving voltage and supplies the driving voltage to the AC LED light emitting unit 220 when the phase of the voltage V1 of the AC power is positive.

The second resistor R2 drops the voltage V1 of the AC power to the driving voltage and supplies the driving voltage to the AC LED light emitting unit 220 when the phase of the voltage V1 of the AC power is negative.

The voltage dropping unit 230 may further include a PTCR between the AC power unit 210 and the AC LED light emitting unit 220. The PTCR is capable of controlling a current applied to the AC LED light emitting unit 220 according to a change of temperature of the AC LED light emitting unit 220.

It is preferable to connect the PTCR in parallel to the first resistor R1 as illustrated in FIG. 7. The PTCR decreases the current applied to the AC LED light emitting unit 220 if the temperature increases due to turn-on of the AC LED light emitting unit 220.

Each of the at least two diode bridges 240 is a full-wave rectifying circuit where four diodes are connected in a rhombus shape forming a positive connection node N1, a negative connection node N2 facing the positive connection node N2, and a pair of input/output nodes N3 and N4 facing each other between the positive connection node N1 and the negative connection node N2. The at least two diode bridges 240 respectively connect the AC LED arrays of the AC LED light emitting unit 220 in a forward direction to the AC power regardless of the polarity of the AC power and full-wave rectify the driving voltage supplied through the voltage dropping unit 230 to respectively supply the rectified driving voltage to the AC LED arrays of the AC LED light emitting unit 220. The at least two diode bridges 240 are connected to each other in series.

For the first diode bridge 240 among the at least two diode bridges 240, a first resistor R1 of the voltage dropping unit 230 is connected to the positive connection node N1, a condenser C2 of the second turn-on switch unit 260 is connected to the negative connection node N2, and the first AC LED array among the at least two AC LED arrays of the AC LED light emitting unit 220 is connected in a forward direction to the AC power unit 210 between the pair of the input/output nodes N3 and N4.

For the last diode bridge 240 among the at least two diode bridges 240, a condenser C1 of the first turn-on switch unit 250 is connected to the positive connection node N1, a second resistor R2 of the voltage dropping unit 230 is connected to the negative connection node N2, and the last AC LED array among the at least two AC LED arrays of the AC LED light emitting unit 220 is connected in a forward direction to the AC power unit 210 between the pair of the input/output nodes N3 and N4.

For the rest of the diode bridges 240 positioned between the first diode bridge 240 and the last diode bridge 240, the negative connection node N2 of a previous diode bridge 240 is connected to the respective positive connection nodes N1, and the AC LED arrays corresponding to the rest of the diode bridges 240 among the at least two AC LED arrays of the AC LED light emitting unit 220 are connected in a forward direction to the AC power unit 210 between the respective pairs of input/output nodes N3 and N4.

For reference, it is exemplarily illustrated in FIG. 7 that 3 diode bridges 240 connected to each other in series and connected in a forward direction to the AC power respectively connect the 3 AC LED arrays LED1 to LED3 of the AC LED light emitting unit 220 in a forward direction to the AC power regardless of the polarity of the AC power and full-wave rectify the driving voltage supplied through the voltage dropping unit 230 to respectively supply the rectified driving voltage to the 3 AC LED arrays LED1 to LED3 of the AC LED light emitting unit 220.

The first turn-on switch unit 250 includes a resistor R3 and the condenser C1 connected to each other in series. One terminal of the resistor R3 is connected to the terminal L1 of the AC power unit 210, and one terminal of the condenser C1 is connected to the diode bridge 240 directly connected to the second resistor R2 of the voltage dropping unit 230 among the at least two diode bridges 240 connected to each other in series.

While the condenser C1 sequentially repeats processes of charging, charging stop, and discharging when the voltage V1 of the AC power is positive, the first turn-on switch unit 250 flows a current to the AC LED array of the AC LED light emitting unit 220 for which the diode bridge 240 directly connected to the second resistor R2 of the voltage dropping unit 230 full-wave rectifies the driving voltage and supplies the rectified driving voltage to turn it on during the processes of charging and discharging.

The condenser C1 repeats the process of charging, charging stop on completion of charging, and discharging when the voltage V1 of the AC power of the AC power unit 210 is positive. Herein, a charging time and a discharging time may be determined by adjusting a time constant determined by the resistor R3 and the condenser C1 connected to each other in series.

When the voltage V1 of the AC power of the AC power unit 210 is positive, even though a magnitude of a voltage applied to the AC LED light emitting unit 220 is smaller than that of a turn-on voltage determined according to the number of AC LED arrays of the AC LED light emitting unit 220, the first turn-on switch unit 250 flows the current to the AC LED array of the AC LED light emitting unit 220 for which the diode bridge 240 directly connected to the second resistor R2 of the voltage dropping unit 230 full-wave rectifies the driving voltage and supplies the rectified driving voltage to turn it on during the processes of charging and discharging of the condenser C1.

In the case of FIG. 7, during the processes of charging and discharging of the condenser C1, among the 3 AC LED arrays LED1 to LED3 of the AC LED light emitting unit 220, the AC LED array LED3, for which the diode bridge 240 directly connected to the second resistor R2 of the voltage dropping unit 230 full-wave rectifies the driving voltage and supplies the rectified driving voltage, is turned on. Herein, after the condenser C1 starts to charge, impedance of the condenser C1 is low before completion of charging. Therefore, the current flows to the AC LED array LED3 for which the diode bridge 240 directly connected to the second resistor R2 of the voltage dropping unit 230 full-wave rectifies the driving voltage and supplies the rectified driving voltage so that only the LED3 is turned on. If charging is completed, the impedance of the condenser C1 becomes high blocking the current flow, and at the same time, the current flows through the 3 LED arrays LED1 to LED 3 for which the 3 diode bridges 240 connected to each other in series between the first resistor R1 and the second resistor R2 of the voltage dropping unit 230 full-wave rectify the driving voltage and supply the rectified driving voltage so that all of the 3 AC LED arrays LED1 to LED3 are turned on. During the process of discharging after stop of charging, due to a charging voltage of the condenser C1, the current flows to the AC LED array LED3 for which the diode bridge 240 directly connected to the second resistor R2 of the voltage dropping unit 230 full-wave rectifies the driving voltage and supplies the rectified driving voltage so that only the LED3 is turned on.

The second turn-on switch unit 260 includes a resistor R4 and the condenser C2 connected to each other in series. One terminal of the resistor R4 is connected to the terminal L2 of the AC power unit 210, and one terminal of the condenser C2 is connected to the diode bridge 240 directly connected to the first resistor R1 of the voltage dropping unit 230 among the at least two diode bridges 240 connected to each other in series.

While the condenser C2 sequentially repeats processes of charging, charging stop, and discharging when the voltage V1 of the AC power is negative, the second turn-on switch unit 260 flows a current to the AC LED array of the AC LED light emitting unit 220 for which the diode bridge 240 directly connected to the first resistor R1 of the voltage dropping unit 230 full-wave rectifies the driving voltage and supplies the rectified driving voltage to turn it on during the processes of charging and discharging.

The condenser C2 repeats the process of charging, charging stop on completion of charging, and discharging when the voltage V1 of the AC power of the AC power unit 210 is negative. Herein, a charging time and a discharging time may be determined by adjusting a time constant determined by the resistor R4 and the condenser C2 connected to each other in series.

When the voltage V1 of the AC power of the AC power unit 210 is negative, even though the magnitude of the voltage applied to the AC LED light emitting unit 220 is smaller than that of the turn-on voltage determined according to the number of AC LED arrays of the AC LED light emitting unit 220, the second turn-on switch unit 260 flows the current to the AC LED array of the AC LED light emitting unit 220 for which the diode bridge 240 directly connected to the first resistor R1 of the voltage dropping unit 230 full-wave rectifies the driving voltage and supplies the rectified driving voltage to turn it on during the processes of charging and discharging of the condenser C2.

In the case of FIG. 7, during the processes of charging and discharging of the condenser C2, among the 3 AC LED arrays LED1 to LED3 of the AC LED light emitting unit 220, the AC LED array LED1, for which the diode bridge 240 directly connected to the first resistor R1 of the voltage dropping unit 230 full-wave rectifies the driving voltage and supplies the rectified driving voltage, is turned on. Herein, after the condenser C2 starts to charge, impedance of the condenser C2 is low before completion of charging. Therefore, the current flows to the AC LED array LED1 for which the diode bridge 240 directly connected to the first resistor R1 of the voltage dropping unit 230 full-wave rectifies the driving voltage and supplies the rectified driving voltage so that only the LED1 is turned on. If charging is completed, the impedance of the condenser C2 becomes high blocking the current flow, and at the same time, the current flows through the 3 LED arrays LED1 to LED 3 for which the 3 diode bridges 240 connected to each other in series between the first resistor R1 and the second resistor R2 of the voltage dropping unit 230 full-wave rectify the driving voltage and supply the rectified driving voltage so that all of the 3 AC LED arrays LED1 to LED3 are turned on. During the process of discharging after stop of charging, due to a charging voltage of the condenser C2, the current flows to the AC LED array LED1 for which the diode bridge 240 directly connected to the first resistor R1 of the voltage dropping unit 230 full-wave rectifies the driving voltage and supplies the rectified driving voltage so that only the LED1 is turned on.

An operation of the AC LED light emitting device 200' according to the third embodiment of the present invention is described as follows.

When the phase of the voltage V1 of the AC power such as AC 110V or AC 220V provided by the AC power unit 210 is positive, the 3 AC LED arrays LED1 to LED3 of the AC LED light emitting unit 220 including at least one AC LED connected to each other in series and connected in a forward direction to the terminal L1 of the AC power unit 210 are turned on by the driving voltage supplied after being full-wave rectified by the 3 diode bridges 240 connected to each other in series between the first resistor R1 and the second resistor R2 of the voltage dropping unit 230.

On the contrary, when the phase of the voltage V1 of the AC power is negative, the 3 AC LED arrays LED1 to LED3 of the AC LED light emitting unit 220 including at least one AC LED connected to each other in series and connected in a forward direction to the terminal L1 of the AC power unit 210 are turned on by the driving voltage supplied after being full-wave rectified by the 3 diode bridges 240 connected to each other in series between the first resistor R1 and the second resistor R2 of the voltage dropping unit 230.

Meanwhile, the AC power such as the AC 110V or AC 220V supplied to the AC LED light emitting device 200' shows sine wave characteristics having a positive polarity at a phase of 0° to 180° and a negative polarity at a phase of 180° to 360° within one period with a frequency of generally 60 Hz as illustrated in FIG. 5A.

Also, if the magnitude of the voltage applied to the AC LED light emitting unit 220 including at least two AC LED arrays each of which including at least one AC LED is smaller than the turn-on voltage determined according to the number of AC LED arrays of the AC LED light emitting unit 220, the AC LED light emitting device 200' flows a current to at least one AC LED array among the at least two AC LED arrays of the AC LED light emitting unit 220 to turn it on during one period of the AC power such as the AC 110V or AC 220V. If the magnitude of the voltage applied to the AC LED light emitting unit 220 is larger than the turn-on voltage of the AC LED light emitting unit 220, all of the AC LED arrays of the AC LED light emitting unit 220 are turned on.

Actually, at the phase of 0° to 180° where the phase of the voltage V1 of the AC power showing the sine wave characteristics is positive, if it is assumed that a time taken for the magnitude of the voltage to reach the turn-on voltage of the AC LED light emitting unit 220 is t1, a time where the magnitude of the voltage is kept as higher than the turn-on voltage is t2, and a time where the magnitude of the voltage drops below the turn-on voltage again is t3, the time t1 corresponds to a phase of approximately 0° to 45° where the phase of the voltage V1 of the AC power is positive, the time t2 corresponds to a phase of approximately 45° to 135° where the phase of the voltage V1 of the AC power is positive, and the time t3 corresponds to a phase of approximately 135° to 180° where the phase of the voltage V1 of the AC power is positive.

Herein, as illustrated in FIG. 5B, in the case that the magnitude of the voltage applied to the AC LED light emitting unit 220 is lower than the turn-on voltage of the AC LED light emitting unit 220 at the phase of 0° to 180° where the phase of the voltage V1 of the AC power is positive, e.g., at the phase of approximately 0° to 45° and at the phase of approximately 135° to 180°, the current flows to the AC LED array LED3 directly connected to the second resistor R2 of the voltage dropping unit 230 among the 3 AC LED arrays LED1 to LED3 to turn it on.

At the phase of approximately 0° to 45°, the magnitude of the voltage applied to the AC LED array LED3 of the AC LED light emitting unit 220, for which the diode bridge 240 directly connected to the second resistor R2 of the voltage dropping unit 230 full-wave rectifies the driving voltage and supplies the rectified driving voltage, is larger than the turn-on voltage of the AC LED array LED3 during the process of charging of the condenser C1 and the impedance of the condenser C1 is low before completion of charging after charging is started. Therefore, the current flows to the AC LED array LED3 of the AC LED light emitting unit 220, for which the diode bridge 240 directly connected to the second resistor R2 of the voltage dropping unit 230 full-wave rectifies the driving voltage and supplies the rectified driving voltage, among the 3 AC LED arrays LED1 to LED3 of the AC LED light emitting unit 220 so that only the LED3 is turned on.

At the phase of approximately 135° to 180°, during the process of discharging of the condenser C1, the magnitude of the charging voltage of the condenser C1, i.e., the magnitude of the voltage applied to the AC LED array LED3 of the AC LED light emitting unit 220, for which the diode bridge 240 directly connected to the second resistor R2 of the voltage dropping unit 230 full-wave rectifies the driving voltage and supplies the rectified driving voltage, is larger than the turn-on voltage of the AC LED array LED3. Therefore, the current flows to the AC LED array LED3 of the AC LED light emitting unit 220, for which the diode bridge 240 directly connected to the second resistor R2 of the voltage dropping unit 230 full-wave rectifies the driving voltage and supplies the rectified driving voltage, among the 3 AC LED arrays LED1 to LED3 of the AC LED light emitting unit 220 so that only the LED3 is turned on.

Also, as illustrated in FIG. 5B, in the case that the magnitude of the voltage applied to the AC LED light emitting unit 220 is larger than the turn-on voltage of the AC LED light emitting unit 220 at the phase of 0° to 180° where the phase of the voltage V1 of the AC power is positive, e.g., at the phase of approximately 45° to 135°, if the charging process of the condenser C1 is completed, the impedance of the condenser C1 becomes high blocking the current flow, and at the same time, the current flows through the 3 LED arrays LED1 to LED 3 for which the 3 diode bridges 240 connected to each other in series between the first resistor R1 and the second resistor R2 full-wave rectify the driving voltage and supply the rectified driving voltage so that all of the 3 AC LED arrays LED1 to LED3 are turned on.

On the contrary, at the phase of 180° to 360° where the phase of the voltage V1 of the AC power is negative, if it is assumed that that a time taken for the magnitude of the voltage to reach the turn-on voltage of the AC LED light emitting unit 220 is t4, a time where the magnitude of the voltage is kept as higher than the turn-on voltage is t5, and a time where the magnitude of the voltage drops below the turn-on voltage again is t6, the time t4 corresponds to a phase of approximately 180° to 225° where the phase of the voltage V1 of the AC power is negative, the time t5 corresponds to a phase of approximately 225° to 315° where the phase of the voltage V1 of the AC power is negative, and the time t6 corresponds to a phase of approximately 315° to 360° where the phase of the voltage V1 of the AC power is negative.

Herein, as illustrated in FIG. 5B, in the case that the magnitude of the voltage applied to the AC LED light emitting unit 220 is lower than the turn-on voltage of the AC LED light emitting unit 220 at the phase of 180° to 360° where the phase of the voltage V1 of the AC power is negative, e.g., at the phase of approximately 180° to 225° and at the phase of approximately 315° to 360°, the current flows to the AC LED array LED1 directly connected to the first resistor R1 of the voltage dropping unit 230 among the 3 AC LED arrays LED1 to LED3 to turn it on.

At the phase of approximately 180° to 225°, the magnitude of the voltage applied to the AC LED array LED1 of the AC LED light emitting unit 220, for which the diode bridge 240 directly connected to the first resistor R1 of the voltage dropping unit 230 full-wave rectifies the driving voltage and supplies the rectified driving voltage, is larger than the turn-on voltage of the AC LED array LED1 during the process of charging of the condenser C2 and the impedance of the condenser C2 is low before completion of charging after charging is started. Therefore, the current flows to the AC LED array LED1 of the AC LED light emitting unit 220, for which the diode bridge 240 directly connected to the first resistor R1 of the voltage dropping unit 230 full-wave rectifies the driving voltage and supplies the rectified driving voltage, among the 3 AC LED arrays LED1 to LED3 of the AC LED light emitting unit 220 so that only the LED1 is turned on.

At the phase of approximately 135° to 180°, during the process of discharging of the condenser C2, the magnitude of the charging voltage of the condenser C2, i.e., the magnitude of the voltage applied to the AC LED array LED1 of the AC LED light emitting unit 220, for which the diode bridge 240 directly connected to the first resistor R1 of the voltage dropping unit 230 full-wave rectifies the driving voltage and supplies the rectified driving voltage, is larger than the turn-on voltage of the AC LED array LED1. Therefore, the current flows to the AC LED array LED1 of the AC LED light emitting unit 220, for which the diode bridge 240 directly connected to the first resistor R1 of the voltage dropping unit 230 full-wave rectifies the driving voltage and supplies the rectified driving voltage, among the 3 AC LED arrays LED1 to LED3 of the AC LED light emitting unit 220 so that only the LED1 is turned on.

Also, as illustrated in FIG. 5B, in the case that the magnitude of the voltage applied to the AC LED light emitting unit 220 is larger than the turn-on voltage of the AC LED light emitting unit 220 at the phase of 180° to 360° where the phase of the voltage V1 of the AC power is negative, e.g., at the phase of approximately 225° to 315°, if the charging process of the condenser C2 is completed, the impedance of the condenser C2 becomes high blocking the current flow, and at the same time, the current flows through the 3 LED arrays LED1 to LED 3 for which the 3 diode bridges 240 connected to each other in series between the first resistor R1 and the second resistor R2 full-wave rectify the driving voltage and supply the rectified driving voltage so that all of the 3 AC LED arrays LED1 to LED3 are turned on.

As described above, in the AC LED light emitting device 200' according to the third embodiment of the present invention, the current continuously flows to the AC LED light emitting unit 220 during the whole of one period of the AC power so that partial or all of the AC LED arrays are turned on. Accordingly, in comparison with the conventional AC LED light emitting device, the lighting efficiency of the AC LED light emitting unit is high and the power consumption is reduced. Further, due to continuity of the operating current, the THD is decreased to approximately 10% to 25% and the flicker is remarkably reduced.

[Embodiment 4]

Figure 8:
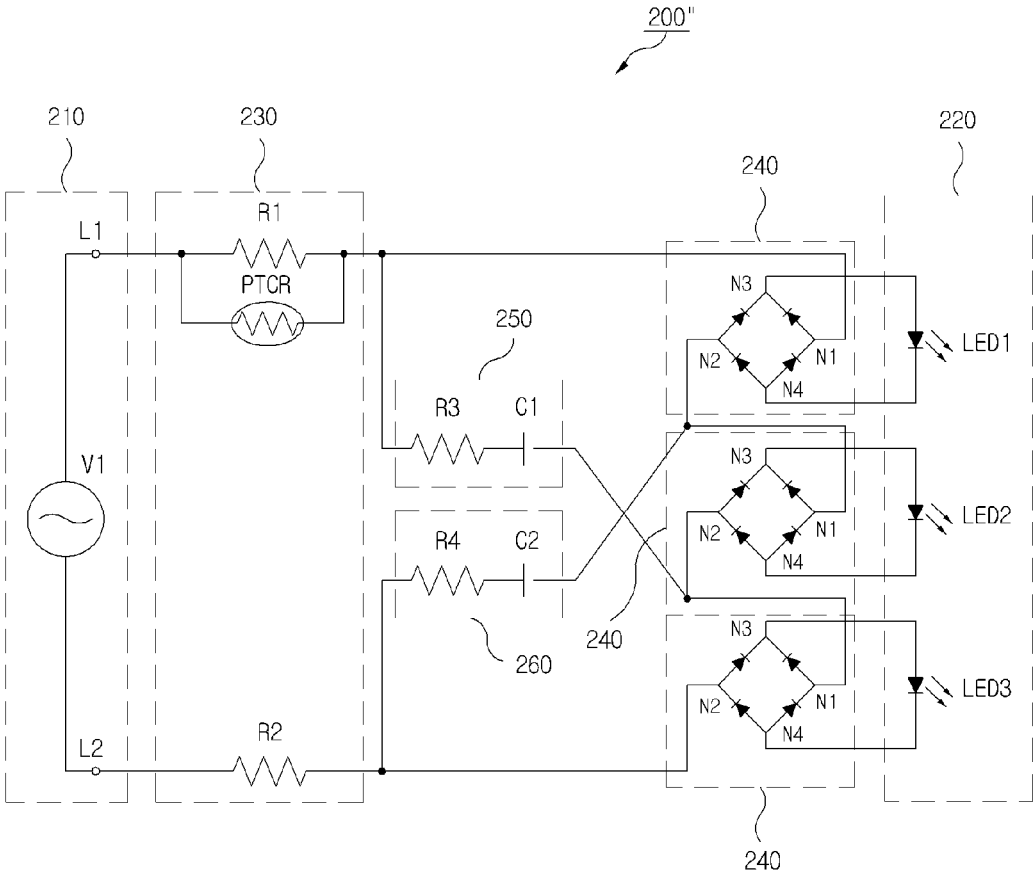
FIG. 8 is a diagram illustrating an AC LED light emitting device according to a fourth embodiment of the present invention.

FIG. 8 is a diagram illustrating an AC LED light emitting device according to a fourth embodiment of the present invention.

In comparison with the AC LED light emitting device 200' according to the third embodiment of the present invention, an AC LED light emitting device 200" according to the fourth embodiment of the present invention has a different wiring structure for the first turn-on switch unit 250 and the second turn-on switch unit 260 and includes the same components, i.e., the AC power unit 210, the AC LED light emitting unit 220, the voltage dropping unit 230, the at least two diode bridges 240, the first turn-on switch unit 250, and the second turn-on switch unit 260.

Referring to FIG. 8, one terminal of the resistor R3 of the first turn-on switch unit 250 is connected to the first resistor R1 of the voltage dropping unit 230. While the condenser C1 sequentially repeats processes of charging, charging stop, and discharging by an output voltage of the first resistor R1, the first turn-on switch unit 250 flows a current to the AC LED array of the AC LED light emitting unit 220 for which the diode bridge 240 directly connected to the second resistor R2 of the voltage dropping unit 230 full-wave rectifies the driving voltage and supplies the rectified driving voltage to turn it on during the processes of charging and discharging.

Referring to FIG. 8, one terminal of the resistor R4 of the second turn-on switch unit 260 is connected to the second resistor R2 of the voltage dropping unit 230. While the condenser C2 sequentially repeats processes of charging, charging stop, and discharging by an output voltage of the second resistor R2, the second turn-on switch unit 260 flows a current to the AC LED array of the AC LED light emitting unit 220 for which the diode bridge 240 directly connected to the first resistor R1 of the voltage dropping unit 230 full-wave rectifies the driving voltage and supplies the rectified driving voltage to turn it on during the processes of charging and discharging.

Since an operation of the AC LED light emitting device 200" according to the fourth embodiment of the present invention is the same as that of the AC LED light emitting device 200' according to the third embodiment of the present invention except that the charging voltage of the condenser C1 of the first turn-on switch unit 250 and the condenser C2 of the second turn-on switch unit 260 is applied through the voltage dropping unit 230, detailed explanations are omitted.

As described above, in the AC LED light emitting device 200" according to the fourth embodiment of the present invention, the current continuously flows to the AC LED light emitting unit 220 during the whole of one period of the AC power so that partial or all of the AC LED arrays are turned on. Accordingly, in comparison with the conventional AC LED light emitting device, the lighting efficiency of the AC LED light emitting unit is high and the power consumption is reduced. Further, due to continuity of the operating current, the THD is decreased to approximately 10% to 25% and the flicker is remarkably reduced.

According to the present invention, during the whole of one period of the AC power, the current flows to the AC LED light emitting unit so that partial or all of the AC LED arrays are turned on. Therefore, in comparison with the conventional AC LED light emitting device, the lighting efficiency of the AC LED light emitting unit is high and the power consumption is reduced. Further, due to continuity of the operating current, the THD is decreased to approximately 10% to 25% and the flicker is remarkably reduced.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A light emitting device using an alternating current (AC) light emitting diode (LED), the light emitting device comprising:

an AC power unit providing an AC power and having a first power output terminal and a second power output terminal;

a voltage dropping unit including a first resistor having a first terminal connected to the first power output terminal, and a second resistor having a first terminal connected to the second power output terminal;

an AC LED light emitting unit including a first AC LED light emitting unit including a first AC LED having an anode terminal connected to a second terminal of the first resistor of the voltage dropping unit, a second AC LED having a cathode terminal connected to a second terminal of the second resistor of the voltage dropping unit, and at least one AC LED connected between the first AC LED of the first AC LED light emitting unit and the second AC LED of the first AC LED light emitting unit, the AC LEDs of the first AC LED light emitting unit being connected to each other in series; and a second AC LED light emitting unit including a first AC LED having the cathode terminal connected to a second terminal of the first resistor of the voltage dropping unit, a second AC LED having an anode terminal connected to the second terminal of the second resistor of the voltage dropping unit, and at least one AC LED connected between the first AC LED of the second AC LED light emitting unit and the second AC LED of the second AC LED light emitting unit, the AC LEDs of the second AC LED light emitting unit being connected to each other in series, wherein the first AC LED light emitting unit is connected in opposing parallel to the second AC LED light emitting unit, and a cathode terminal of each AC LED of the first AC LED light emitting unit is connected to an anode terminal of a corresponding AC LED of the second AC LED light emitting unit;

a first turn-on switch unit including a third resistor having a first terminal connected to the first terminal of the first resistor of the voltage dropping unit, and a first condenser having a first terminal connected to an anode terminal of the second AC LED of the first AC LED light emitting unit, and having a second terminal connected to a second terminal of the third resister, wherein the first turn-on switch unit is connected in parallel with a series circuit comprised of the first resistor, the first AC LED of the first AC LED light emitting unit and the at least one AC LED connected between the first and the second AC LED of the first AC LED light emitting unit; and a second turn-on switch unit including a fourth resistor having a first terminal connected to the first terminal of the second resistor of the voltage dropping unit, and a second condenser having a first terminal connected to an anode terminal of the first AC LED of the second AC LED light emitting unit, and having a second terminal connected to a second terminal of the fourth resister, wherein the second turn-on switch unit is connected in parallel with a series circuit comprised of the second resistor, the second AC LED of the second AC LED light emitting unit and the at least one AC LED connected between the first and the second AC LED of the second AC LED light emitting unit.

2. The light emitting device of claim 1, wherein the first turn-on switch unit flows current to the second AC LED of the first AC LED light emitting unit to turn on the second AC LED of the first AC LED light emitting unit for a time period that voltage applied to the first AC LED light emitting unit is lower than a turn-on voltage determined according to a number of AC LEDs included in the first AC LED light emitting unit when a phase of voltage of the AC power is positive.

3. The light emitting device of claim 1, wherein the second turn-on switch unit flows current to the first AC LED of the second AC LED light emitting unit to turn on the first AC LED of the second AC LED light emitting unit for a time period that voltage applied to the second AC LED light emitting unit is lower than a turn-on voltage determined according to a number of AC LEDs included in the second AC LED light emitting unit when a phase of voltage of the AC power is negative.

4. A light emitting device using an alternating current (AC) light emitting diode (LED), the light emitting device comprising:

an AC power unit providing an AC power and having a first power output terminal and a second power output terminal;

a voltage dropping unit including a first resistor having a first terminal connected to the first power output terminal, and a second resistor having a first terminal connected to the second power output terminal;

an AC LED light emitting unit including a first diode bridge having a positive connection node connected to a second terminal of the first resistor of the voltage dropping unit, a negative connection node facing the positive connection node, two output nodes facing each other between the positive connection node and the negative connection node of the first diode bridge, and at least one AC LED connected between the two output nodes of the first diode bridge, a second diode bridge having a negative connection node connected to a second terminal of the second resistor of the voltage dropping unit, a positive connection node facing the negative connection node, two output nodes facing each other between the positive connection node and the negative connection node of the second diode bridge, and at least one AC LED connected between the two output nodes of the second diode bridge, and at least one diode bridge connected in series between the first diode bridge and the second diode bridge, the at least one diode bridge having a positive connection node connected to a negative node of an adjacent diode bridge, a negative connection node connected to a positive connection node of an opposite adjacent diode bridge, two output nodes facing each other between the positive connection node and the negative connection node of the at least one diode bridge; and at least one AC LED connected between the two output nodes of the at least one diode bridge;

a first turn-on switch unit including a third resistor having a first terminal connected to the first terminal of the first resistor of the voltage dropping unit, and a first condenser having a first terminal connected to the positive connection node of the second diode bridge of the AC LED light emitting unit and having a second terminal connected to a second terminal of the third resister, wherein the first turn-on switch unit is connected in parallel with a series circuit comprised of the first resistor, the first diode bridge of the AC LED light emitting unit and the at least one diode bridge connected between the first and the second diode bridge of the AC LED light emitting unit; and a second turn-on switch unit including a fourth resistor having a first terminal connected to the first terminal of the second resistor of the voltage dropping unit, and a second condenser having a first terminal connected to the negative connection node of the first diode bridge of the AC LED light emitting unit, and having a second terminal connected to a second terminal of the fourth resister, wherein the second turn-on switch unit is connected in parallel with a series circuit comprised of the second resistor, the second diode bridge of the AC LED light emitting unit and the at least one diode bridge connected between the first and the second diode bridge of the AC LED light emitting unit.

5. The light emitting device of claim 4, wherein the first condenser sequentially repeats processes of charging, charging stop, and discharging by an output voltage of the first resistor, and the first turn-on switch unit flows current to the second diode bridge to turn on the at least one AC LED of the second diode bridge during the charging and discharging processes.

6. The light emitting device of claim 4, wherein the second condenser sequentially repeats processes of charging, charging stop, and discharging by an output voltage of the second resistor, and the second turn-on switch unit flows current to the first diode bridge to turn on the at least one AC LED of the first diode bridge during the charging and discharging processes.

7. The light emitting device of claim 4, wherein the first turn-on switch unit flows current to the second diode bridge directly connected to the second resistor and the second diode bridge rectifies a driving voltage and supplies the rectified driving voltage, to turn on the at least one AC LED of the second diode bridge during the charging and discharging processes of the first condenser even though a voltage applied to the AC LED light emitting unit is lower than a turn-on voltage determined according to a number of AC LEDs included in the AC LED light emitting unit when a phase of voltage of the AC power is positive.

8. The light emitting device of claim 5, wherein the first turn-on switch unit flows current to the second diode bridge directly connected to the second resistor and the second diode bridge rectifies a driving voltage and supplies the rectified driving voltage, to turn on the at least one AC LED of the second diode bridge during the charging and discharging processes of the first condenser even though a voltage applied to the AC LED light emitting unit is lower than a turn-on voltage determined according to a number of AC LEDs included in the AC LED light emitting unit when a phase of voltage of the AC power is positive.

9. The light emitting device of claim 4, wherein the second turn-on switch unit flows current to the first diode bridge directly connected to the first resistor and the first diode bridge rectifies a driving voltage and supplies the rectified driving voltage, to turn on the at least one AC LED of the first diode bridge during the charging and discharging processes of the second condenser even though a voltage applied to the AC LED light emitting unit is lower than a turn-on voltage determined according to a number of AC LEDs included in the AC LED light emitting unit when a phase of voltage of the AC power is negative.

10. The light emitting device of claim 6, wherein the second turn-on switch unit flows current to the first diode bridge directly connected to the first resistor and the first diode bridge rectifies a driving voltage and supplies the rectified driving voltage, to turn on the at least one AC LED of the first diode bridge during the charging and discharging processes of the second condenser even though a voltage applied to the AC LED light emitting unit is lower than a turn-on voltage determined according to a number of AC LEDs included in the AC LED light emitting unit when a phase of voltage of the AC power is negative.

* * * * *